US007128433B2

(12) United States Patent
Schlosser

(10) Patent No.: US 7,128,433 B2
(45) Date of Patent: Oct. 31, 2006

(54) GUEST CHECK PRESENTER

(76) Inventor: Marc Schlosser, 3601 Carlton Pl., Boca Raton, FL (US) 33496

( * ) Notice: Subject to any disclaimer, the term of this patent is extended or adjusted under 35 U.S.C. 154(b) by 49 days.

(21) Appl. No.: 10/713,484

(22) Filed: Nov. 14, 2003

(65) Prior Publication Data

US 2004/0099546 A1 May 27, 2004

(51) Int. Cl.
*F21V 33/00* (2006.01)

(52) U.S. Cl. ..... 362/98; 362/154; 362/99

(58) Field of Classification Search ..... 362/99, 362/98, 157, 234, 154; 359/809, 807; 108/50.11; 434/317; 340/815.74, 321; 705/400
See application file for complete search history.

(56) References Cited

U.S. PATENT DOCUMENTS 5,016,147 A * 5/1991 Voorhees ..... 362/99
5,355,115 A * 10/1994 Goor et al. ..... 340/321
5,471,347 A * 11/1995 Galiani ..... 359/807
6,581,822 B1 * 6/2003 Garran ..... 229/116.4
6,637,907 B1 * 10/2003 Levy ..... 362/98
6,796,673 B1 * 9/2004 Dempsey et al. ..... 362/154
2003/0012013 A1 * 1/2003 Herrera ..... 362/99
2004/0059689 A1 * 3/2004 Masden ..... 705/400

* cited by examiner

*Primary Examiner*—Sandra O'Shea
*Assistant Examiner*—Anabel Ton
(74) *Attorney, Agent, or Firm*—Robert M. Downey, PA

(57) ABSTRACT

A guest check presenter has a top cover and bottom cover hinged together along a common binding to define a booklet. A holder is provided on the inside of the booklet for placement of a check for delivery to a patron, such as at the end of a meal in a restaurant. A magnifying sheet movable in overlying relation to the check and a light-emitting device are provided to enhance viewing information printed on the check, particularly in poor lighting conditions. A calculator for totaling items on the check includes tip calculating buttons of graduated values for selecting the tip amount according to the quality of service and/or the generosity of the patron paying the check. A mirror is provided on the inside of the guest check presenter booklet for the convenience of the guests at the table. Signaling lights on the light-emitting device alert the waiter to pick up the check when the patron is ready to pay.

14 Claims, 2 Drawing Sheets

GUEST CHECK PRESENTER

BACKGROUND OF THE INVENTION

1. Field of the Invention

The present invention is directed to a device for delivering a check to a patron, such as in a restaurant, and more particularly, to a guest check presenter including a calculator, a light-emitting device, and means for magnifying printed information on the check held within the booklet.

2. Discussion of the Related Art

In most restaurants, the check for dining patrons is delivered to the table on a small tray or in a booklet commonly referred to as a guest check presenter. The guest check presenter booklet is particularly convenient and usually provides means for securing the credit card and check on the inside, while politely concealing the check total and credit card information from other guests. When a check is delivered to the table, most diners will review the items and prices on the check to confirm that the check total is correct. When multiple parties are dining together at the same table, it may be desirable to separately add the food and beverage totals for each party so that the check can be fairly divided, with each party paying their appropriate share of the check total and tip amount.

In most instances, the electrical lighting and natural light in a restaurant is suppressed in order to enhance the dining atmosphere with candlelight. While this lighting scheme provides for greater ambience, it is often difficult to read the check in such dimly lit conditions. Often, diners will hold the check near the candlelight in a desperate attempt to read the information printed thereon. In some restaurants, waiters even carry small flashlights to assist dining guests when paying the check. The small print which is typical on most restaurant checks and credit card receipts only adds to the difficulty in reading the check, particularly for those who may be farsighted. And, a further problem is encountered when it is time to calculate the check total and tip amount, as well as the amount owed by each party in the instance the check is being divided among two or more parties. Some people find it difficult to perform these mathematical computations, especially without the use of a calculator.

Accordingly, there remains an urgent need in the relevant art for a device for delivering a check to a patron in a restaurant, and wherein the device includes means for enhancing the visibility of information printed on the check, particularly in poor lighting conditions. More specifically, there is a need for a guest check presenter which includes a light-emitting device for directing light onto the check and a magnifying device for enlarging the printed indicia on the check and credit card receipt. Moreover, there is a need for a guest check presenter which further provides a calculator for totaling the check amount and tip, and for dividing the check total and tip amount among two or more parties.

OBJECTS AND ADVANTAGES OF THE INVENTION

With the foregoing in mind, it is a primary object of the present invention to provide a guest check presenter, in the form of a booklet, which includes a light-emitting device and magnifying means for enhancing the visibility of printed information on a bill, check, menu, receipt or the like, particularly in poor lighting conditions.

It is still a further object of the present invention to provide a guest check presenter booklet which includes a calculator for calculating a check total and tip amount, and for further dividing the check total and tip amount among two or more parties.

It is still a further object of the present invention to provide a guest check presenter, in the form of a booklet, which includes a magnifying film or sheet which is moveably disposed in overlying relation to a check, receipt or the like which is held within the booklet.

It is still a further object of the present invention to provide a light-emitting device which removably attaches to a guest check presenter booklet, menu or the like for directing light onto printed text or other indicia in order to enhance viewing, particularly in poorly lit or dim light conditions.

It is still a further object of the present invention to provide a light-emitting device on a guest check presenter booklet for directing light onto the check in order to enhance visibility of the check, particularly in poorly lit or dim light conditions, and further wherein the light-emitting device includes one or more signaling lights for alerting a waitress/waiter that the payment of the check is ready to be picked up at the patron's table.

It is yet a further object of the present invention to provide a guest check presenter, in the form of a booklet, which includes means for holding a check, receipt or the like, as well as a light-emitting device, calculator, mirror and means for magnifying information on the check, receipt, etc.

It is still a further object of the present invention to provide a guest check presenter which includes a calculator having means for quickly calculating tips in graduated amounts.

These and other objects and advantages of the present invention are more readily apparent with reference to the detailed description and accompanying drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
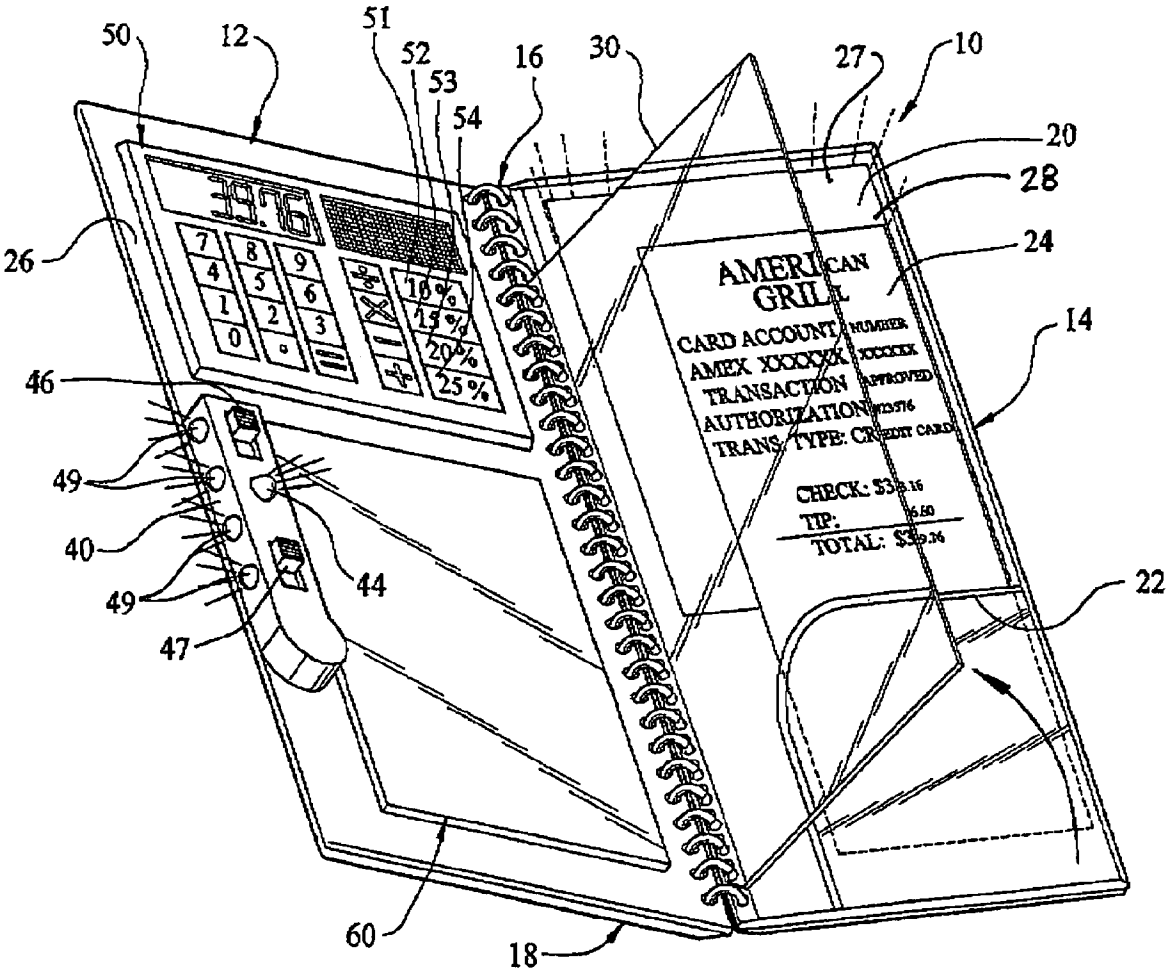
FIG. 1 is a top perspective view of the guest check presenter of the present invention, shown with the top cover open to expose a restaurant check or credit card receipt held herein.
Figure 2:
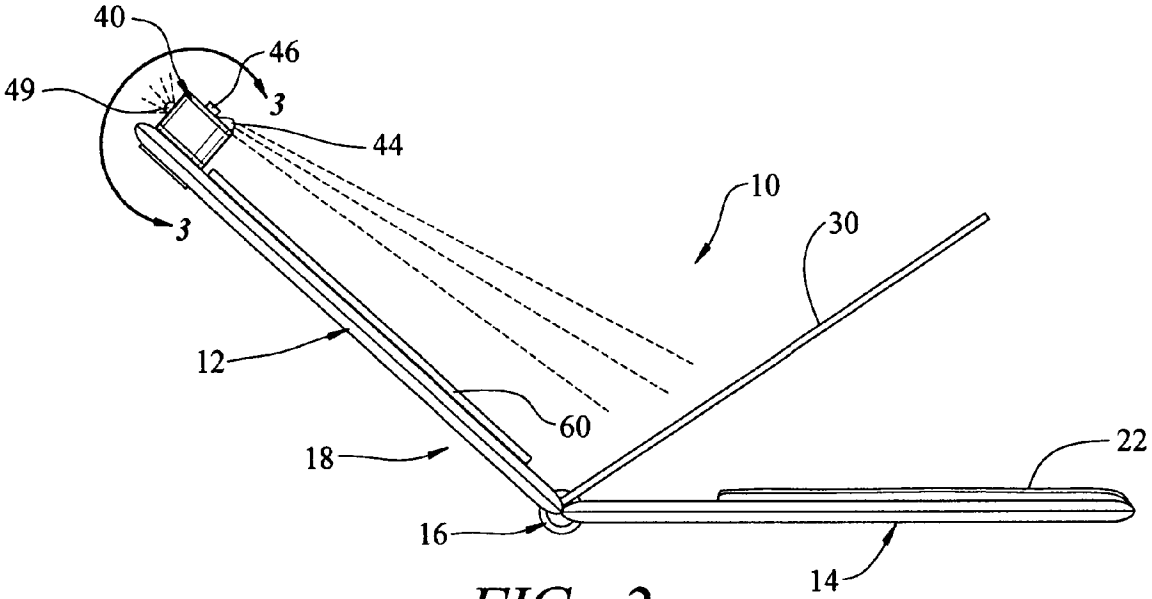
FIG. 2 is bottom end elevational view of the guest check presenter of FIG. 1 showing a light-emitting device directing light through a magnifying sheet and onto the check or receipt held on the inside bottom cover.

Referring to the several views of the drawings, and initially FIGS. 1 and 2, the guest check presenter is shown and is generally indicated as 10. The guest check presenter 10 includes a top cover 12 and a bottom cover 14 hinged along a common binding 16 to define a booklet 18. The binding 16 may be of a spiral type, as shown, or any other conventionally known binding which is typically used in the construction of guest check presenters of the booklet type.

As seen in FIG. 1, the inside face 20 of the bottom cover 14 is provided with a flap 22 defining a holder for a check 24 (e.g. a restaurant check), a credit card receipt or other similar paper sheet. The flap is specifically structured for insertion of the check or receipt 24 between the flap and the inside face 20 of the bottom cover to hold the check within the booklet so that the printed indicia on the check, receipt, etc. is clearly visible when the top cover 12 is open, as seen in FIG. 1. In a preferred embodiment, the flap 22 is made of a transparent material so that printed information on a bottom half of the check or receipt 24 is clearly visible when the check, receipt, etc. is held under the flap. A pocket or other means may be provided on the inside of either the top or bottom cover for holding a credit card.

A plastic transparent film or sheet 30 having light-refractive qualities is moveably disposed on an inside of the booklet for magnifying the text, numbers and other indicia on the check 24, receipt, etc. held under the flap 22. In a preferred embodiment, the plastic magnifying sheet 30 is bound to the binding 16 so that the magnifying sheet 30 overlies the flap 22 and check, receipt, etc. held on the inside face 20 of the bottom cover 14. In this manner, the magnifying sheet 30 can be lifted and moved away from the check 24 to vary the magnification of the printed indicia on the check, as it appears when viewing through the transparent magnifying sheet.

Figure 4:
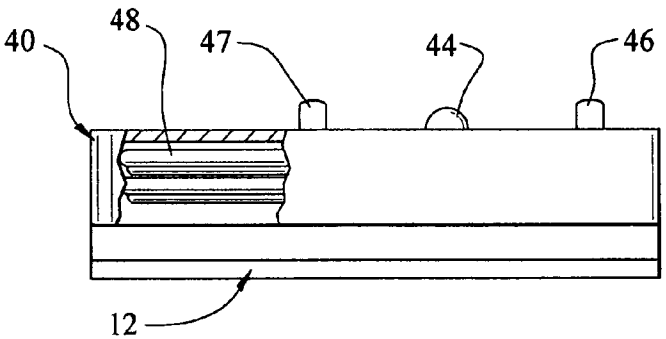
FIG. 4 is an isolated side elevational view, in partial cutaway, showing the battery, a lamp, and switches on the light-emitting device.
Figure 3:
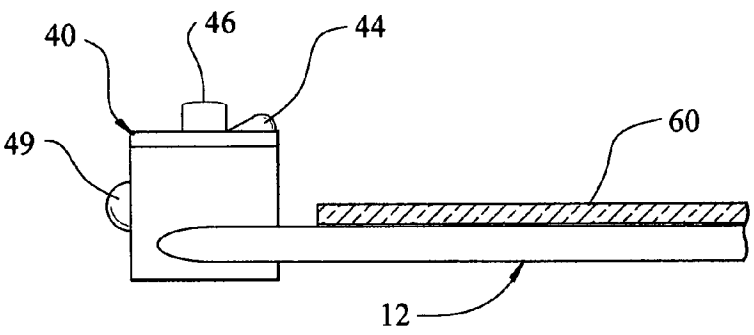
FIG. 3 is an isolated view of the light-emitting device taken from the area indicated as 3 in FIG. 2.

A light-emitting device 40 attaches to the top cover 12 and includes one or more lamps 44 which direct light through the magnifying sheet 30 and onto the inside face 20 of the bottom cover, and particularly the check positioned thereon. The light-emitting device 40 may be permanently affixed to the top cover 12. Alternatively, the light-emitting device 40 may be structured for removable attachment to the side edge of the top cover, as shown in FIGS. 3 and 4. The ability to remove the light-emitting device 40 provides for the convenience of changing batteries and replacing a new light-emitting device on the guest check presenter in the event of malfunction. It is important to note that the light-emitting device 40 is further useful on other booklet or panel devices, particularly in a restaurant. For instance, the light-emitting device 40 may be attached to the cover of a menu or the side edge of a single panel menu, such as a desert list or special menu.

In a preferred embodiment, the light-emitting device is provided with at least one lamp 44 conveniently positioned and disposed for directing light through the transparent magnifying sheet 30 and onto the check, as seen in FIG. 2. A switch (e.g. a button or slide switch) 46, operable by the patron, closes a circuit in order to deliver power from battery power source 48 to the lamp 44, thereby activating illumination of the lamp. In a preferred embodiment, the battery power source 48 comprises one or more flat cell batteries. In use, the top cover of the guest check presenter is normally held with the left hand and the switch 46 on the light-emitting device 40 is activated by using the thumb or another finger. The transparent magnifying sheet 30 is moved and adjustably positioned with the right hand until the desired level of magnification of the check information is achieved.

The light-emitting device 40 also includes one or more signaling lamps 49 for alerting the waitress/waiter when the patron's payment is ready to be picked up at the table. The one or more signaling lamps 49 may be of varying colors or the same color, such as red. In a preferred embodiment, the signaling lamps 49 are LEDs. Further, the signaling lamps 49 may, when activated, emit a steady light or, alternatively, may be of a flashing type. The signaling lamps 49 are specifically positioned and disposed to be easily visible to a waitress/waiter in the proximity of a patron's table with the guest check presenter booklet 10 closed and awaiting pick up for payment processing. In a preferred embodiment, the signaling lamps 49 are actuated by an independent switch 47 on the light-emitting device 40. Similar to the switch 46 for activating lamp 44, the switch 47 may be of any well known type, such as a passive slide switch which is selectively operated between a fixed on or off position or, alternatively, a pressure activated switch or contact switch (e.g. magnetic or sliding) which may be structured to actuate the signaling lamps 49 when the top cover 12 is closed. To avoid unnecessary drain of power on the battery source 48, it may be preferable to use a switch which is operable to a fixed off position when not in use. As an alternative to the two switches 46 and 47 shown in the drawings, a single three-way switch may be used to operate both the lamp 44 and the signaling lamps 49. Specifically, a three-way switch is operable from an off position to a first on position to active lamp 44 and a second on position which turns off the lamp 44 and activates the signaling lamps 49.

To further enhance the visibility of printed indicia on the check 24 or other sheet substrate held on the inside face of the bottom cover, a backlight 27 is provided. The backlight 27 is built into the bottom cover and is structured to emit light through a transparent or translucent panel 28 on the inside face 20 of the bottom cover 14. Light emitted from the backlight 27, as shown in figure 1, is directed through the check 24 or other sheet substrate, to enhance the visibility of printed indicia on the check 24, particularly in dark or dim light conditions. The backlight 27 is actuated by a contact switch, such as a magnetic contact switch or sliding contacts, so that when the top cover is opened, the backlight 27 is illuminated, thereby illuminating the sheet substrate 24 held on the back panel.

A preferred embodiment of the guest check presenter 10 further includes a calculator 50 fixed to the inside face 26 of the top cover 12, as seen in FIG. 1. The calculator 50 is preferably solar powered and may include tip calculation buttons 51–54 for calculating a tip of varying amounts. Specifically, several tip calculating buttons may be provided, each having a specific percentage value, whereupon the desired amount of a tip may be conveniently and quickly tabulated, while taking into account, for instance, the quality of service and generosity of the paying patron.

The guest check presenter may further be provided with a mirror 60 fixed to the inside face 26 of the top cover 12 for the convenience of all of the guests at the table while awaiting completion of the meal. The mirror is particularly useful for application of make-up, such as lipstick, prior to leaving the table at the end of a meal.

For marketing and promotion purposes, advertisements may be placed on the guest check presenter 10, including any of the components described above. Specifically, business names, with a telephone number and/or address may be silkscreened, printed or otherwise attached to the top cover 12, bottom cover 14, the light-emitting device 40, the transparent panel 28 of the backlight 27, the flap 22, the calculator 50, the transparent magnifying sheet 30 and/or the mirror 60.

While the instant invention has been shown and described in accordance with preferred and practical embodiments thereof, it is recognized that departures from the instant disclosure are contemplated within the spirit and scope of the present invention.

What is claimed is:

1. A booklet comprising:

a top cover and a bottom cover, said top and bottom covers each including an inner face, and said top and bottom covers hinged together along a common binding for allowing movement of said top and bottom covers between an open position, wherein said inner faces of said top and bottom covers are visibly exposed, and a closed position wherein said top cover is positioned in overlying relation to said bottom cover to conceal said inner faces;

said inner face of said bottom cover being structured and disposed for holding a sheet substrate thereon;

an electronic calculator attached to said booklet;

a light emitting device structured and disposed to direct light onto the sheet substrate;

a transparent sheet between said top and bottom covers, and said transparent sheet being structured and disposed for magnifying images viewed through said transparent sheet including images appearing on said sheet substrate; and a plurality of signaling lamps of multiple colors position and disposed to be visible when said top and bottom covers are in said closed position.

2. The booklet as recited in claim 1 wherein said transparent sheet is movable in relation to said inner face of said bottom cover and the sheet substrate held thereon.

3. The booklet as recited in claim 1 wherein said plurality of signaling lamps are structured and disposed to emit a steady light when actuated.

4. The booklet as recited in claim 1 wherein said plurality of signaling lamps are structured and disposed to emit an intermittent flashing light when actuated.

5. The booklet as recited in claim 1 wherein each of said plurality of signaling lamps are individually actuated.

6. The booklet as recited in claim 1 further comprising a mirror attached to said booklet.

7. The booklet as recited in claim 6 wherein said mirror is attached to said inner face of said top cover.

8. A device comprising:

at least one cover panel having a top side and a bottom side;

said bottom side being structured and disposed for placement of a sheet substrate thereon;

a light emitting source structured and disposed to direct light onto said sheet substrate;

said light emitting source including a backlight device on said bottom side of said cover panel for directing light outwardly therefrom and through the sheet substrate placed thereon;

an electronic calculator on said cover panel;

at least one signaling lamp for emitting a distinct light having a character which is clearly identifiable and distinguishable from said light emitting source; and a transparent sheet structured and disposed for magnifying images viewed therethrough including images on said sheet substrate.

9. A booklet comprising:

a top cover and a bottom cover, said top and bottom covers each including an inner face, and said top and bottom covers hinged together along a common binding for allowing movement of said top and bottom covers between an open position, wherein said inner faces of said top and bottom covers are visibly exposed, and a closed position wherein said top cover is positioned in overlying relation to said bottom cover to conceal said inner faces;

said inner face of said bottom cover being structured and disposed for holding a sheet substrate thereon;

an electronic calculator attached to said booklet;

a light emitting device structured an disposed to direct light onto the sheet substrate;

a transparent sheet between said top and bottom covers, said transparent sheet being structured and disposed for magnifying images viewed through said transparent sheet including images on said sheet substrate; and at least one signaling lamp positioned and disposed to be visible when said top and bottom covers are in said closed position and said at least one signaling lamp is actuated, and said at least one signaling lamp being structured and disposed for emitting a distinct light having a character which is clearly identifiable and distinguishable from said light emitting device.

10. The booklet as recited in claim 9 further comprising a mirror attached to a said booklet.

11. The booklet as recited in claim 9 further comprising:

a plurality of said signaling lamps.

12. The booklet as recited in claim 11 wherein said plurality of signaling lamps are structured and disposed to emit a steady light when actuated.

13. The booklet as recited in claim 11 wherein said plurality of signaling lamps are structured and disposed to emit an intermittent flashing light when actuated.

14. The booklet as recited in claim 11 wherein said plurality of signaling lamps are of multiple colors.

* * * * *